US008020863B2

(12) United States Patent
König et al.

(10) Patent No.: US 8,020,863 B2
(45) Date of Patent: Sep. 20, 2011

(54) METHOD AND DEVICE FOR TRANSPORTING A FLAT OBJECT

(75) Inventors: Klaus König, Constance (DE); Meinhard Nattermann, Grand Prairie, TX (US); Armin Zimmermann, Constance (DE)

(73) Assignee: Siemens AG, Munich (DE)

( * ) Notice: Subject to any disclaimer, the term of this patent is extended or adjusted under 35 U.S.C. 154(b) by 292 days.

(21) Appl. No.: 12/202,934

(22) Filed: Sep. 2, 2008

(65) Prior Publication Data

US 2009/0115127 A1 May 7, 2009

(30) Foreign Application Priority Data

Aug. 30, 2007 (DE) ..... 10 2007 041 006

(51) Int. Cl.

| | |
|---|---|
| ***B65H 7/02*** | (2006.01) |
| ***B65H 5/02*** | (2006.01) |
| ***B65H 5/04*** | (2006.01) |
| ***B65G 15/00*** | (2006.01) |

(52) U.S. Cl. ..... 271/265.04; 271/273; 198/626.3

(58) Field of Classification Search ..... 271/272, 271/273, 265.01, 265.04; 198/626.3
See application file for complete search history.

(56) References Cited

U.S. PATENT DOCUMENTS

| | | | | |
|---|---|---|---|---|
| 3,203,534 | A | 8/1965 | Burkhardet et al. | |
| 3,951,257 | A | 4/1976 | Storace et al. | |
| 4,973,039 | A * | 11/1990 | Jeske et al. | 271/151 |
| 4,995,504 | A | 2/1991 | Kühn | |
| 5,568,917 | A * | 10/1996 | Buschhaus et al. | 270/58.01 |
| 6,107,579 | A | 8/2000 | Kinnemann | |
| 6,385,406 | B1 * | 5/2002 | Funamizu et al. | 399/16 |
| 6,443,448 | B1 | 9/2002 | Mohr et al. | |
| 6,450,323 | B1 | 9/2002 | Agier et al. | |
| 6,861,592 | B2 | 3/2005 | Gerstenberg et al. | |
| 7,096,743 | B2 | 8/2006 | Vogel et al. | |
| 7,344,016 | B2 * | 3/2008 | Vogel et al. | 198/412 |
| 7,641,193 | B2 * | 1/2010 | Barinaga et al. | 271/277 |
| 2001/0024013 | A1 * | 9/2001 | Horikoshi et al. | 271/272 |
| 2005/0000299 | A1 | 1/2005 | Vogel et al. | |
| 2005/0161877 | A1 * | 7/2005 | Sumi | 271/272 |
| 2005/0242497 | A1 * | 11/2005 | Ishikawa et al. | 271/273 |
| 2006/0249438 | A1 | 11/2006 | Schwarzbauer et al. | |

(Continued)

FOREIGN PATENT DOCUMENTS

DE 19528828 C1 8/1996

(Continued)

*Primary Examiner* — Kaitlin S Joerger
*Assistant Examiner* — Patrick Cicchino
(74) *Attorney, Agent, or Firm* — Laurence A. Greenberg; Werner H. Stemer; Ralph E. Locher

(57) ABSTRACT

A method and a device transport a flat object, especially a mail item, over a conveyor path. The transport device has two conveyor elements, a thickness sensor and a gap-altering device. With the aid of the thickness sensor the thickness of the object is measured, before the object reaches the conveyor path. With the aid of the gap-altering device the gap between the two conveyor elements is set to a computed value. The effect of this setting is that after the setting the gap is smaller than the measured thickness and the difference between the measured thickness and the gap is smaller than a predetermined limit. This setting is concluded before the subject matter reaches the conveyor path. The two conveyor elements clamp the object for a time between themselves and transport the clamped object over the conveyor path.

16 Claims, 4 Drawing Sheets

U.S. PATENT DOCUMENTS

| | | | | |
|---|---|---|---|---|
| 2008/0041698 | A1* | 2/2008 | Schererz et al. | 198/463.3 |
| 2008/0315512 | A1* | 12/2008 | Naruoka et al. | 271/265.01 |
| 2010/0059932 | A1* | 3/2010 | Neubauer et al. | 271/265.01 |

FOREIGN PATENT DOCUMENTS

| | | | |
|---|---|---|---|
| DE | 19753419 | C1 | 2/1999 |
| DE | 10319723 | B3 | 9/2004 |
| DE | 102004022027 | B3 | 12/2005 |
| EP | 0785827 | B1 | 7/1997 |
| EP | 0881956 | B1 | 12/1998 |
| EP | 0775657 | B1 | 5/2001 |
| EP | 1154944 | B1 | 11/2001 |
| EP | 1400790 | B1 | 3/2004 |
| WO | 2004030835 | A1 | 4/2004 |

* cited by examiner

METHOD AND DEVICE FOR TRANSPORTING A FLAT OBJECT

CROSS-REFERENCE TO RELATED APPLICATION

This application claims the priority, under 35 U.S.C. §119, of German application DE 10 2007 041 006.0, filed Aug. 30, 2007; the prior application is herewith incorporated by reference in its entirety.

BACKGROUND OF THE INVENTION

Field of the Invention

The invention relates to a method and a device for transporting a flat object, especially a mail item, over a conveyor path.

A sorting system sorts mail items depending on their respective destination address. In such case the sorting system transports a stream of mail items with the aid of conveyor belts. The problem arises that the mail items can have different thicknesses and that the thicknesses can vary in an unpredictable sequence and distribution.

In European patent EP 1154944 B1, corresponding to U.S. Pat. No. 6,450,323 B1, flat mail items are transported in an upright position. For transport a mail item is at times clamped between two endless conveyor belts (reference symbol 4 and 5) and is transported by the turning conveyor belts. The conveyor belt 5 in this case is pressed by a number of elastically deformable rollers 6 against the conveyor belt 4. The rollers 6 are supported to allow rotation and are on vertical shafts. Since the rollers 6 are deformable, the conveyor path is capable of transporting mail items of different thickness.

A conveyor containing two endless conveyor belts is also described in U.S. Pat. No. 3,951,257. These conveyor belts are guided around a number of rollers in each case. A few of the rollers are spring-loaded. This enables a thick mail item to enlarge the gap between the conveyor belts. The spring reduces the gap again if the transport of the mail item over the conveyor path has been ended.

German patent DE 195 28 828 C1 and German patent DE 197 53 419 C1, corresponding to U.S. Pat. No. 6,443,448 B1, propose varying the gap between two consecutive mail items depending on properties of the mail items. An unnecessarily large gap could greatly reduce the throughput of mail items through a sorting system.

German patent DE 103 19 723 B3, corresponding to U.S. Pat. No. 7,344,016 B2, describes the transport of objects in a variable-width conveyor channel. Mail items are transported in an upright position through a conveyor channel and are aligned on their lower edges during this process. They are transported by an underfloor conveyor belt. They are moved without clamping between two conveyor belts positioned to the side. Before a mail item reaches the conveying channel its thickness is measured. The distance between the lateral conveyor belts is changed as a function of its measured thickness. The thicker a mail item, the greater the distance between the lateral conveyor belts.

German patent DE 10 2004 022 027 B3, corresponding to U.S. patent application publication No. 2008/0041698 A1, describes a U-shaped transport channel for the sport of flat, upright mail items. The side walls are formed from two endless conveyor belts 2, 3 as well as a narrow pressure belt 4. The distance between the two conveyor belts 2, 3 is markedly greater than the thickness of a transported mail item. The pressure belt 4 is located below the conveyor belt 3 and is pressed against the conveyor belt 2 by two spring-loaded pressure deflection rollers 13, 16. This clamps a mail item between the conveyor belt 2 and the pressure belt 4. The thickness of this mail item is measured. An actuator moves the pressure diversion rollers 13, 16 as a function of the measured thickness perpendicular to the direction of transport, which alters the gap between the belts 2 and 4.

In U.S. Pat. No. 4,973,039 a stack of sheets is transported in a horizontal position on the conveyor belt (reference symbol 11). So that no sheets can slide out of the stack during transport, the stack is held by a further conveyor belt 13 which is positioned above the stack. Above the conveyor belt 11 is located an endless conveyor belt 22, which is routed via a roller and is turned by the transported stack if this fits the gap between conveyor belts 11 and 22.

A thickness sensor measures the height of the transported stack. The gap between these conveyor belts 11, 22 is changed so that the gap is slightly less than the measured height, preferably only a few hundredths of a millimeter less.

International patent disclosure WO 2004/030835 A1, corresponding to U.S. Pat. No. 7,096,743 B2, describes a device which measures the resistance to bending of a flat mail item. The mail item is clamped for a time between three endless conveyor belts 1, 2a, 2b. When this is done a gap arises between the two conveyor belts 2a, 2b. The thickness of the mail item is measured. A roller 5 is moved perpendicular to the direction of transport, so that the distance between the roller and a straight line connecting the two endless conveyor belts 2a, 2b is about the same as the measured thickness. Subsequently the mail item is transported. The roller 5 is pressed in this manner against the clamped mail item. The deflection of the mail item caused by the roller 5 is measured.

SUMMARY OF THE INVENTION

It is accordingly an object of the invention to provide a method and a device for transporting a flat object that overcome the above-mentioned disadvantages of the prior art methods and devices of this general type, in which the object is transported without the danger of congestion or slipping, and the danger of damage to the transported object is reduced and unnecessary changes to the gap can be avoided.

With the foregoing and other objects in view there is provided, in accordance with the invention, a method for transporting a flat object over a conveyor path. The method includes the steps of measuring a thickness of the flat object for defining a measured thickness and setting a gap between two conveyor elements to a value which depends on the measured thickness, before the flat object reaches the conveyor path, with the gap between the two conveyor elements being set so that, after the setting the gap is the same as or smaller than the measured thickness and a difference between the measured thickness and the gap is the same or is smaller than a predetermined limit. The flat object is transported in an upright position defining an upright object over the conveyor path, with the two conveyor elements gripping the upright object and clamping the upright object between them for a time, and the upright object and the two conveyor elements move at a same speed. The upright object is transported over the conveyor path.

In the transport method and the transport device at least one flat object is transported over a conveyor path. The transport device features two conveyor elements, a thickness sensor and a gap-altering device.

The thickness of the object is measured with the aid of the thickness sensor before the object reaches the conveyor path.

The gap between the two conveyor elements is set to a computed value with the aid of the gap-altering device. The value depends on the measured thickness. The effect of this setting is that, after the setting, the gap is made the same or smaller than the measured thickness and the difference between the measured thickness and the gap is less than a predetermined limit.

This setting is completed before the object reaches the conveyor path.

The transport device transports the flat object in an upright position over the conveyor path. In this case the two conveyor elements grip the upright object and at times clamp it between them. The two conveyor elements move at the same speed and transport the clamped object over the conveyor path.

Because the gap between the two conveyor elements is less than the thickness of the object, the conveyor elements keep the object clamped and gripped while it is being transported over the conveyor path. Because the difference between the thickness and gap set is not greater than a predetermined limit however, damage to the object by strong lateral pressure is avoided. Because the two conveyor elements move at the same speed a jamming or tearing of the flat object is avoided.

Many processing systems process the objects in an upright position. For example a feeder extracts one flat object in each case from a stack of upright flat objects. Such a processing system can be more easily combined with a transport device if the transport device also transports the flat object in an upright position and the object does not have to be turned first.

Preferably the device transports a number of objects in turn over the conveyor path. Before transport of the first object the gap is set to a default value. This standard gap depends on a default value for the thickness of the mail item to be transported. The gap is only set to another value if the thickness of an object to be transported deviates from a standard thickness. In one embodiment the gap is reset to the default gap after the object has been transported over the conveyor path, provided the next object has a thickness that deviates from the default thickness.

In one embodiment the old value in which the gap is recorded is stored in a gap data memory. At the start the gap is set to the default value, and the default value is stored in the data memory. Whenever the gap is set to a new value as a function of the measured thickness of an object to be transported, this value is stored in the gap data memory. If an object is to be transported once more, initially the current gap is determined by reading out the value from the data memory.

Subsequently one of the now described three steps is executed. If the current gap is greater than the measured thickness, the gap is reduced. If the difference between the measured thickness and the current gap is greater than the predetermined limit the gap is enlarged. Otherwise the current gap remains unchanged.

The current gap is thus only changed if this is necessary.

In one embodiment the gap is set as now described. A default gap is set between the two conveyor elements. The default gap depends on a default value for the thickness of the object to be transported. The gap is changed if the measured thickness of the object deviates from the default gap. The default gap is restored after the transport of the object over the conveyor path is completed.

Frequently many objects to be transported have a default thickness. Thanks to the method in accordance with the inventive object fewer operations on average are required to change the gap. Many objects have a thickness which does not deviate or deviates only slightly from the default thickness. If a first object is initially transported, the gap is subsequently reset to the default gap and thereafter a second object is transported and if the second object is as thick as the default thickness, the gap does not need to be altered.

Preferably the gap is only altered if the thickness of the object to be transported deviates by more than a predetermined tolerance from the default thickness.

Other features which are considered as characteristic for the invention are set forth in the appended claims.

Although the invention is illustrated and described herein as embodied in a method and a device for transporting a flat object, it is nevertheless not intended to be limited to the details shown, since various modifications and structural changes may be made therein without departing from the spirit of the invention and Within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the exemplary embodiment the inventive transport device is used in a sorting system that sorts flat mail items. The sorting system has a reader device which reads the respective destination address of each mail item. A system of driven endless conveyor belts transports the mail item through the sorting system and extracts it depending on the respective destination address into one or more sorting compartments.

On its way through the sorting system each mail item is on the one hand to be clamped as firmly as possible. Only then is it guaranteed that the mail item is transported at the same speed at which the conveyor belts are turning, and thereby a predetermined speed is actually maintained during transport. The clamping is preferably brought about by the transported mail item deforming and/or deflecting a conveyor belt of a conveyor path. The friction force exerted by the conveyor belt depends on the reset force which the deformed and/or deflected conveyor belt exerts on the mail item.

On the other hand the mail item should not be damaged during transport, which is why too great a lateral pressure on the mail item is to be avoided.

Figure 1:
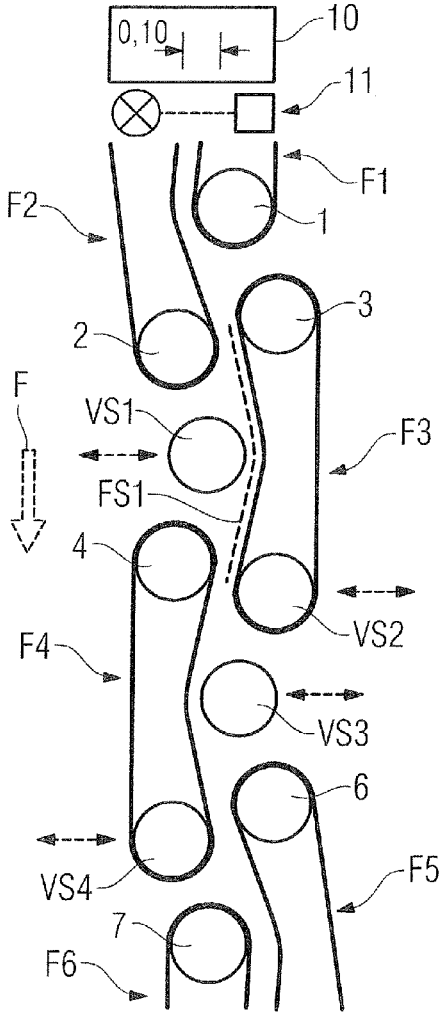
FIG. 1 is a diagrammatic, top plan view of a transport according to the invention.

A section of this system of driven conveyor belts is shown in FIG. 1. Mail items are transported from the top downwards in a direction of transport F. The section shown has the following components:

a thickness sensor 10;
a light barrier 11;
an endless conveyor belt F1 with a driven pulley 1;
an endless conveyor belt F2 with a driven pulley 2;
an endless conveyor belt F3 with a driven pulley VS2 and a non-driven pulley 3;
a non-driven belt diversion roller VS1;
an endless conveyor belt F4 with a driven pulley VS4 and a non-driven pulley 4;
a non-driven belt diversion roller VS3;
an endless conveyor belt F5 with a non-driven pulley 6; and
an endless conveyor belt F7 with a non-driven pulley 7.

The endless conveyor belts are provided in the exemplary embodiment on the outer side with an elastic layer, preferably made of rubber. The layer exhibits a high coefficient of friction. The pulleys and the belt deflection rollers are made of metal. The belt deflection rollers have a smooth surface.

The outer surfaces of the endless conveyor belts are perpendicular to the plane of FIG. 1. In one embodiment each endless conveyor belt consists of two individual endless conveyor belts lying above one another.

The pulleys VS2 and VS4 as well as the belt deflection rollers VS1 and VS3 can be displaced in a direction perpendicular to the direction of transport F. This is indicated in FIG. 1 by the four dashed-line double arrows.

The transport device further possesses a gap-altering device, which is not shown in FIG. 1. The gap-altering device is capable of displacing each adjustable conveyor element VS1, VS2, VS3, VS4 independently of the other conveyor elements by a predetermined distance perpendicular to the direction of transport F to the left or to the right. The gap-altering device possesses actuators as well as a closed-loop controller, which, depending on the measured thickness as well as the previous position of a conveyor element, specifies the distance and the direction in which the conveyor element is to be adjusted. The actuator system makes this height adjustment.

A gap data memory to which the closed-loop controller has read and write access belongs to the gap-altering device. The respective value for the gap between an adjustable conveyor element and the opposing conveyor element is stored in this gap data memory. Each time the gap-altering device alters the gap the old value in the gap data memory is overwritten. In the example shown in FIG. 1 four values for the following four gaps are stored in the gap data memory:

for the gap between VS1 and F3,
for the gap between VS2 and F4,
for the gap between VS3 and F4 and
for the gap between VS4 and F5.

At the beginning of transport a default value is stored in the gap data memory which will be explained below.

Instead of a value for the current gap a value can also be stored in each case which describes the current position of the adjustable conveyor element, e.g. the position on a coordinate axis perpendicular to the direction of conveyance.

The actuators of the gap-altering device perform the height adjustment of the conveyor elements. Such an actuation system is known for example from German patent DE 103 19 723 B4.

In one embodiment the actuator system is embodied so that the gap can be altered steplessly. Especially if the gap is to be adjusted within fractions of seconds, a stepless height adjustment would often be too slow. To guarantee a rapid height adjustment, the conveyor element is always in one of N different positions and is adjusted by being moved into another of these N different positions. For example N=8.

In the exemplary embodiment each mail item is typically transported over a first conveyor path FS1 and a second conveyor path. The first conveyor path FS1 is delimited on one side by the belt pulleys 2 and 4 and the belt deflection roller VS1, and on the other side by that section of the conveyor belt F3 lying between the pulleys 3 and VS2.

The second conveyor path is delimited on one side by the belt pulley VS2 of the belt deflection roller VS3 and on the other side by that section of the conveyor belt F4 lying between the pulleys 4 and VS4.

Two opposing endless conveyor belts are capable of clamping a mail item which is in an upright position between themselves and transporting it by rotation at the same speed in the direction of conveyance F.

In the exemplary embodiment horizontal underfloor endless conveyor belts are located under the endless conveyor belts F1, F2, F5 and F6, but not under the endless conveyor belts F3 and F4.

A mail item is transported through the system of endless conveyor belts and belt deflection rollers and in doing so follows a meandering path. The conveyor belts clasp a transported mail item with a clasp angle of 3 degrees to 5 degrees. In the exemplary embodiment the speed of the mail item during transport remains constant through the arrangement of FIG. 1 and is known.

On its way the mail item first passes the thickness sensor 10. The thickness sensor 10 measures the maximum thickness of the mail item, measured as a distance at right angles to the direction of conveyance F.

Subsequently the mail item passes a light barrier 11. This light barrier 11 is arranged so that there is a predefined distance covered by the mail item between the light barrier 11 and the beginning of the first conveyor path FS1. Because the speed is also known and constant the time required by the mail item to cover the distance to the conveyor path FS1 is fixed.

In the exemplary embodiment the gap-altering device sets the gap that arises between the two opposing conveyor elements VS1 and F3 to a predetermined value. This value depends on the thickness that the thickness sensor 10 has measured. The change to the gap begins at a period of time $\Delta T$ after the front edge of the mail item has passed the light barrier 11. Since the transport speed of the mail item is known, it is established in the exemplary embodiment that the mail item, after $\Delta T$ has elapsed, is only a predetermined distance from the beginning of the first conveyor path FS1 and also only a predetermined distance from the adjustable conveyor element VS1.

In one embodiment the gap is set so that the difference between the thickness of the mail item and the gap always lies in the same predetermined range. For example the difference always lies between 0 mm and 8 mm. In one embodiment the following gap is set as a function of the thickness of the mail item;

| Thickness of the mail item | Gap between the conveyor elements |
|---|---|
| <8 mm | The conveyor elements are pressed onto each other |
| 8 mm-10 mm | The conveyor elements touch without any pressure |
| 10 mm-12 mm | 2 mm |
| >12 mm | 4 mm |

A default thickness for mail items, e.g. 12 mm is predetermined. Depending on this default thickness the adjustable conveyor elements are initially set so that a default gap, e.g. one of 4 mm, is produced. The default gap is set for example when the sorting system has started operation. FIG. 1 shows the transport device before the beginning of the transport with the default gaps.

To set the gap, the gap-altering device determines the old value of the gap e.g. by reading out the gap data memory and/or queries a position sensor for the adjustable conveyor element. The gap-altering device computes a new value for the gap and subsequently from the old actual value and the new setpoint value the distance and direction by which the adjustable conveyor element is to be displaced.

In a development the gap is additionally adjusted depending on the respective weight of the mail item. There is no underfloor conveyor below the endless conveyor belts F3 and F4. The transport of the mail item is exclusively affected by the conveyor elements of the two conveyor paths clamping the mail item between them. The result of this is that the clamping conveyor elements exert a pressure and thereby a friction force on the clamped mail item that compensates for the weight force. The pressure force depends on the resetting force that the deflected conveyor element exerts on the mail item.

In one embodiment the transport device additionally has a weighing system that measures the weight of each mail item passing through it. Such a weighing system is frequently built into the sorting in any event, e.g. because the weight is measured to check the postage. A balance that measures mail items during their movement is known for example from European patents EP 881956 B1 and EP 1400790 B1.

In another embodiment, as well as the thickness, the length of the mail item (the extent in direction of transport F) and the height of the mail item (the extent at right angles to the direction of transport F in the vertical direction) are measured. In trials an average specific weight of a mail item is determined and stored in a data memory of the transport device. The volume is calculated from the thickness, length and height of each mail item. The weight is computed from the volume and the average specific weight.

Each adjustable conveyor element is set so that the gap is all the smaller, the greater is the weight. This enables a higher pressure to be exerted on heavy mail items than on light mail items.

Figure 2:
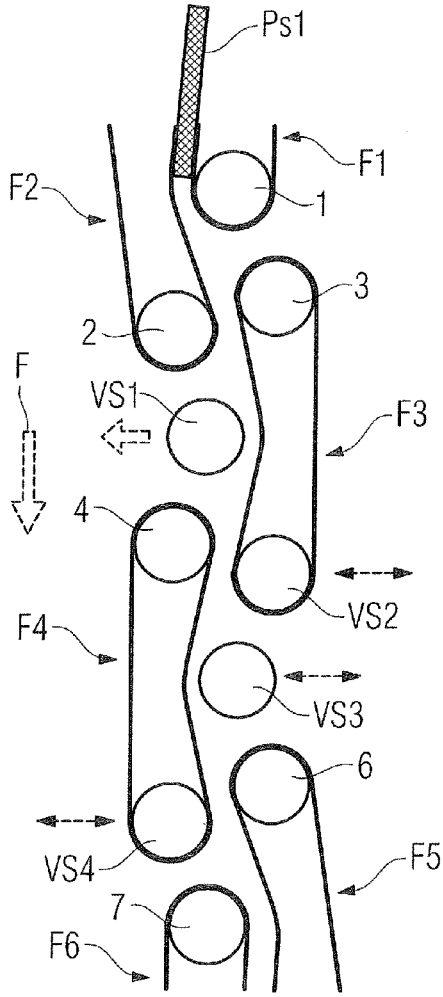
FIG. 2 is a diagrammatic, top plan view of the transport device in which a thick mail item triggers the adjustment of a conveyor element.

FIG. 2 shows the transport device of FIG. 1, in which a thick mail item Ps1 triggers the adjustment of a conveyor element. In the example of FIG. 2 the thick mail item Ps1 has reached the pulley 1. At this moment the process is initiated of the controlled actuation system of the gap-altering device displacing the belt deflection rollers VS1 to the left and thereby increasing the gap between VS1 and F3. The displacement is indicated by a dashed-line arrow. In this way the gap is adapted to the thickness of Ps1.

Figure 3:
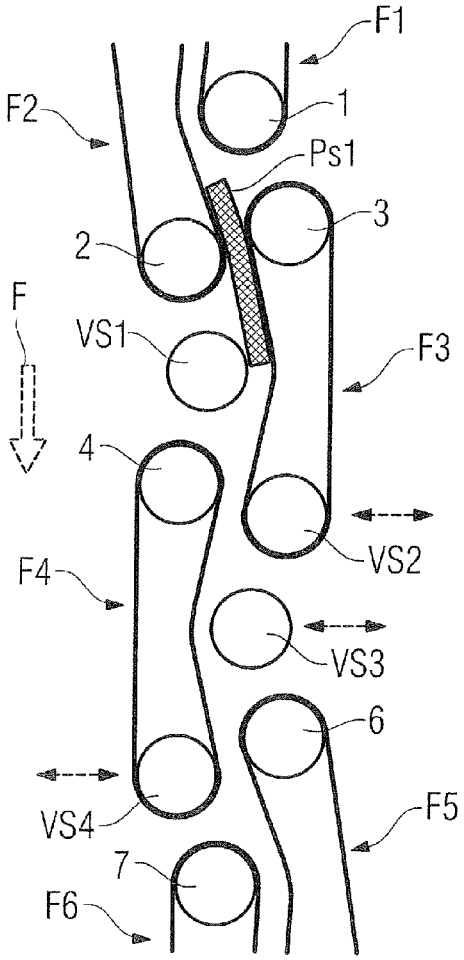
FIG. 3 is a diagrammatic, top plan view of the transport device of FIG. 1 in which the thick mail item reaches the adjusted conveyor element.

The conveyor belts F2 and F3 transport the mail item Ps1 from the position in FIG. 2 to the position in FIG. 3. During this transport the belt deflection roller VS1 is adjusted by being displaced to the left.

FIG. 3 shows the transport device of FIG. 1 in the situation in which the thick mail item of FIG. 2 reaches the adjusted belt deflection roller VS1. The gap between VS1 and F3 is adapted to the thickness of the mail item Ps1. The belt deflection roller VS1 presses the mail item Ps1 onto the conveyor belt F3, and the conveyor belt F3 transports the mail item Ps1 further in the direction of conveyance F.

Figure 4:
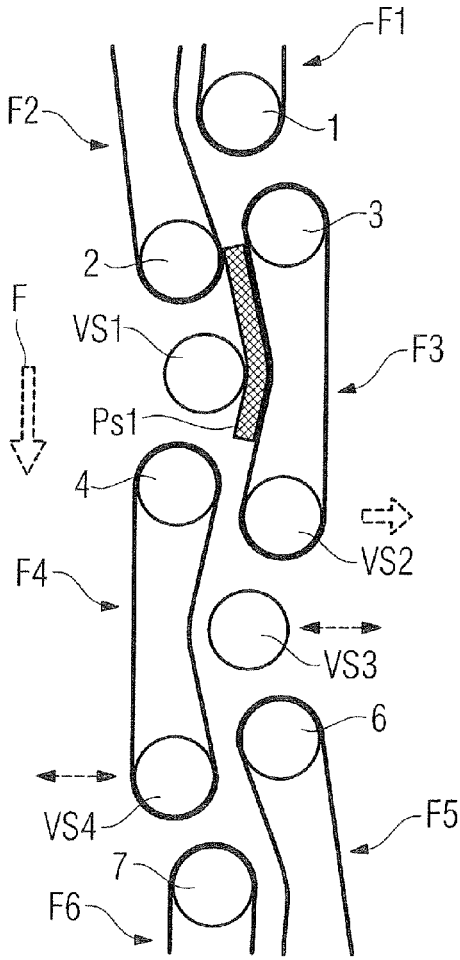
FIG. 4 is a diagrammatic, top plan view of the transport device of FIG. 1 in which the thick mail item of FIG. 3 triggers the adjustment of a further conveyor element.

FIG. 4 shows the transport device of FIG. 1, in which the thick mail item Ps1 of FIG. 3 triggers the adjustment of a further conveyor element, namely the driven pulley VS2. This adjusts the pulley VS2 so that it is displaced to the right which enlarges the gap between the endless conveyor belts F3 and F4.

The adjustment of VS2 is started at the moment at which the mail item Ps1 reaches the position set in FIG. 4. This is affected by the displacement beginning a predetermined period of time after the front edge of the mail item Ps1 has passed the light barrier 11.

Figure 5:
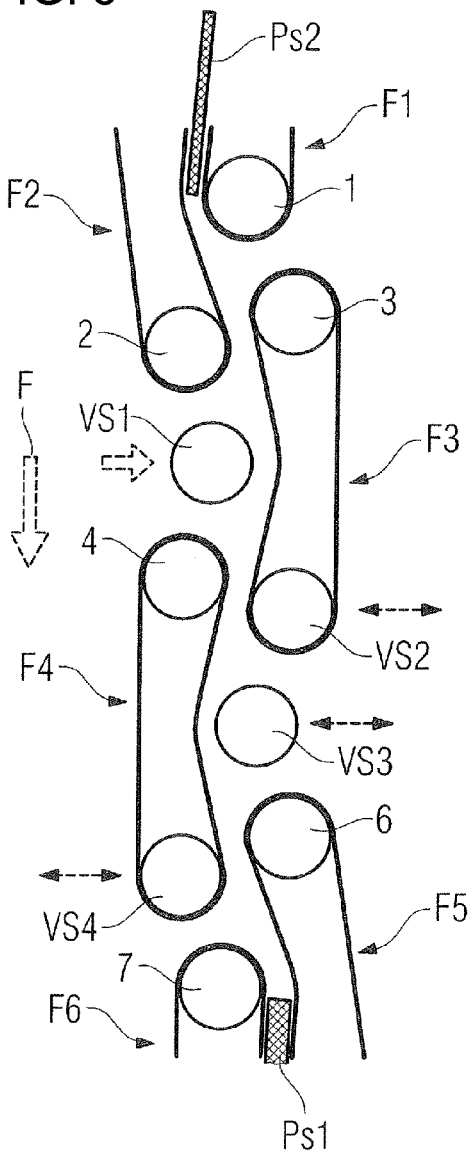
FIG. 5 is a diagrammatic, top plan view of the transport device of FIG. 1 in which a thin mail item triggers the adjustment of a conveyor element.

In the example shown in FIG. 5 a thin mail item Ps2 is transported after the thick mail item Ps1. At the moment at which the thin mail item Ps2 reaches the pulley 1, an adjustment of the belt deflection roller VS1 is initiated. Because the subsequent mail item Ps2 is thinner than the preceding mail item Ps1, the gap between VS1 and F3 is reduced again. This is caused by a displacement of VS1 to the right.

Figure 6:
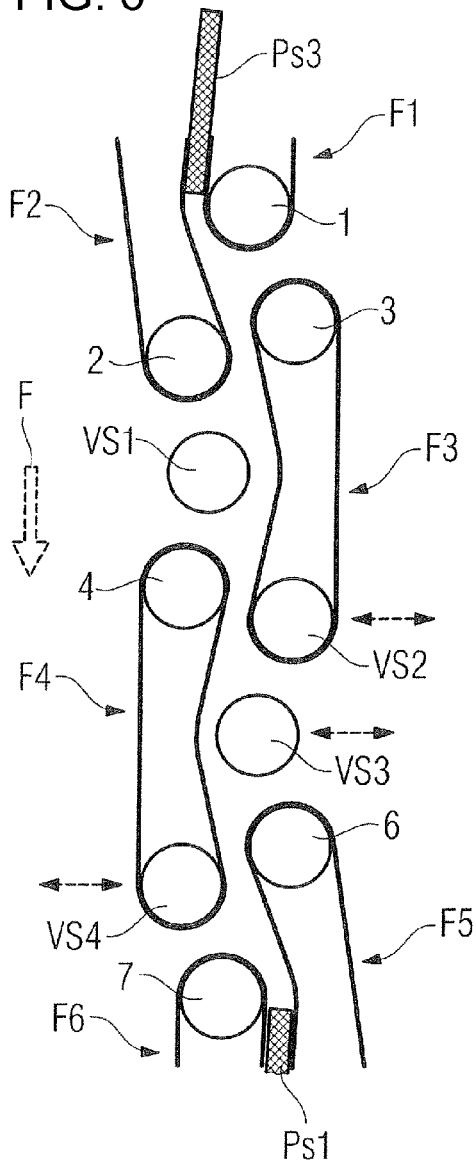
FIG. 6 is a diagrammatic, top plan view of the transport device of FIG. 1 in which a further thick mail item does not trigger any adjustment of a conveyor element.

FIG. 6 shows an alternative to FIG. 5, in the example of FIG. 6 the thick mail item Ps1 is followed by a further thick mail item Ps3. In this situation the adjustable belt deflection roller VS1 remains in the previous position. The adjustment of the belt deflection roller is thus suppressed in the example of FIG. 6.

In one development, as well as the thickness, the stiffness of each mail item is additionally measured, before this reaches the first conveyor path. A method for measuring the stiffness of a mail item is known from international patent disclosure WO 2004/030835 A1.

In the present exemplary embodiment the mail item of which the stiffness is to be measured is fixed at two end points so that it cannot be displaced at these end points in a direction perpendicular to the direction of transport. At a third point of action which lies between the two fixing points, a predetermined force is exerted on the mail item at right angles to the direction of transport. This force bends the mail item and the mail item exerts a resetting force on the element acting on it. The length of the distance by which the mail item is bent at the point of action at which the force is exerted is measured. The longer the distance, the smaller the stiffness.

In one variant the mail item is bent far enough for the deflection at the point of action to be equal to a predetermined distance. The size of the resetting force that the mail item exerts is measured. The greater the resetting force, the greater the stiffness.

The stiffness governs the time at which the adjustment of the conveyor element is started. A mail item with a high level of stiffness can only be bent at a slight angle to the direction of transport. Thus the adjustment of the conveyor element is started late.

Figure 7:
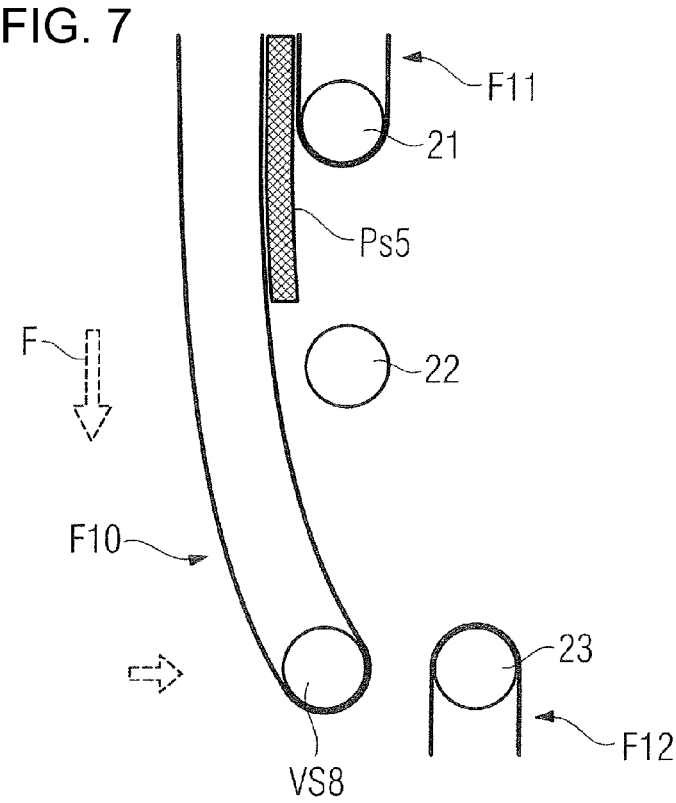
FIG. 7 is a diagrammatic, top plan view of the transport device which measures the stiffness of a mail item during the transport of a thin mail item.
Figure 8:
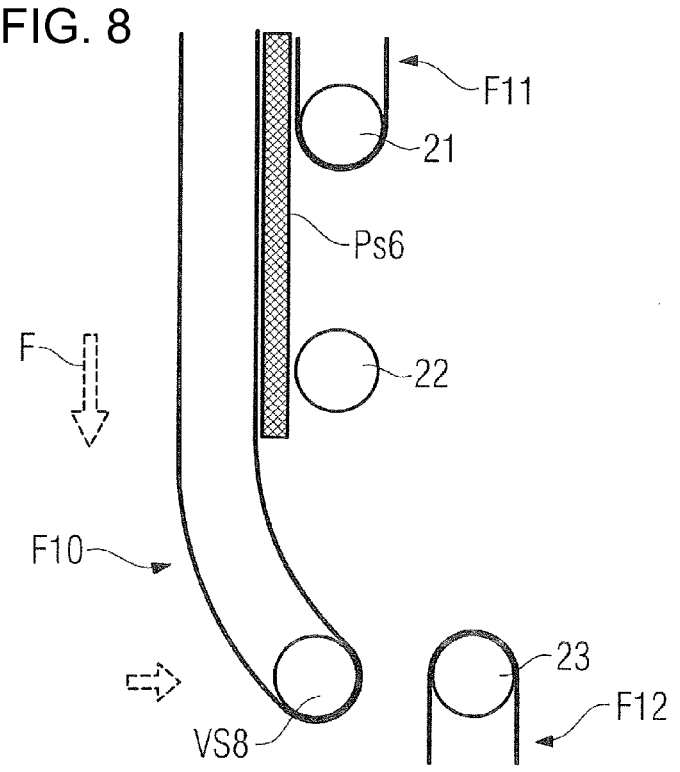
FIG. 8 is a diagrammatic, top plan view of the transport device of FIG. 7 during transport of a thick mail item.

FIG. 7 and FIG. 8 illustrate a transport device which adjusts the gap as a function of the stiffness of a transported mail item. This transport device includes an endless conveyor belt F10 which is guided around an adjustable pulley VS8, an endless-conveyor belt F11 which is guided around a pulley 21, an endless conveyor belt F12 which is guided around a pulley 23, and a non-adjustable belt deflection roller 22.

Both in FIG. 7 and also in FIG. 8 the gap between the conveyor belts F10 and F12 is too large because a thick mail item has been previously transported, and the gap is to be reduced. The reduction is brought about by the adjustable pulley VS8 being displaced to the right. This is indicated by a dashed arrow.

Both in FIG. 7 and also in FIG. 8 show the situation at the moment at which the adjustment of VS8 begins. The mail item Ps5 of FIG. 7 and the mail item Ps6 of FIG. 8 are the same thickness. However the mail item Ps5 of FIG. 7 is less stiff and can bend. The mail item Ps6 of FIG. 8 has a high level of stiffness and is quite rigid.

As can be seen, in the example of FIG. 7 the displacement begins even before the bendable mail item Ps5 has reached the belt roller 22. The bendable mail item Ps5 can adapt itself to the conveyor belt F10. In the example of FIG. 8 the displacement begins after the front edge of the rigid mail item Ps6 has passed the belt deflection roller 22. The rigid mail item Ps6 can hardly adapt to the conveyor belt F10.

The invention claimed is:

1. A method for transporting a flat object over a conveyor path, which comprises the steps of:

measuring a thickness of the flat object for defining a measured thickness;

setting a gap between two conveyor elements to a computed value which depends on the measured thickness, before the flat object reaches the conveyor path, with the gap between the two conveyor elements being set so that, after the setting the gap is smaller than the measured thickness and a difference between the measured thickness and the gap is the same or is smaller than a predetermined limit;

transporting the flat object in an upright position defining an upright object over the conveyor path, with the two conveyor elements gripping the upright object and clamping the upright object between them for a time, and the upright object and the two conveyor elements moving at a same speed; and transporting the upright object over the conveyor path.

2. The method according to claim 1, which further comprises changing the gap so that, for each said measured thickness the difference between the thickness and the gap lies in a same predetermined range.

3. The method according to claim 1, which further comprises, if the measured thickness lies below a predetermined thickness limit, setting the gap between the two conveyor elements so that after the setting the two conveyor elements touch and are pressed against each other with a predetermined pressure.

4. The method according to claim 1, which further comprises:

determining the value that the gap between the two conveyor elements has before the setting; and performing one of the following:

reducing the gap if the gap is greater than the measured thickness;

enlarging the gap if the difference between the measured thickness and the gap is greater than the predetermined limit; and leaving the gap unchanged.

5. The method according to claim 4, which further comprises:

setting a default gap between the two conveyor elements as the gap in dependence on a predetermined default thickness;

storing a value for the default gap in a gap data memory;

storing a new value in the gap data memory whenever the gap is set to a new value; and the determination of the value that the gap between the two conveyor elements has before the setting includes the step of the value in the gap data memory being read out.

6. The method according to claim l, which further comprises:

setting a default gap between the two conveyor elements as the gap in dependence on a predetermined default thickness;

altering the gap if the measured thickness of the flat object deviates from the default gap; and restoring the default gap after the transport of the flat object over the conveyor path is completed.

7. The method according to claim 6, which further comprises:

after the flat object is transported, transporting, via the two conveyor elements a subsequent object over the conveyor path;

measuring a thickness of the subsequent object thus defining a further thickness before the subsequent object reaches the conveyor path;

suppressing a setting of the default gap if the further thickness deviates from a default thickness; and setting the gap between the two conveyor elements in such a way that after the setting the gap is the same as or smaller than the further thickness and a difference between the further thickness and the gap is smaller than the predetermined limit.

8. The method according to claim 1, which further comprises altering the gap by at least one of the conveyor elements being displaced in a displacement direction which is at right angles or at an angle to a direction in which the flat object is being transported.

9. The method according to claim 8, wherein:

at least one displaced conveyor element includes an endless conveyor belt guided around a pulley; and a displacement of the conveyor element includes the step of the pulley being displaced in the displacement direction.

10. The method according to claim 1, wherein a clamping of the flat object causes a deformation of at least one of the two conveyor elements.

11. The method according to claim 1, which further comprises measuring a maximum thickness of the flat object at right angles to the conveyor path as the thickness.

12. The method according to claim 1, which further comprises measuring a stiffness of the flat object before the flat object reaches the conveyor path and an alteration of the gap is concluded all the later, the greater the stiffness is.

13. The method according to claim 1, which further comprises:

measuring a weight of the flat object before the flat object reaches the conveyor path; and changing the gap so that the gap is all the smaller, the greater a measured weight is.

14. A transport device for transporting a flat object over a conveyor path, the transport device comprising:

two conveyor elements;

a thickness sensor for measuring a thickness of the flat object before the flat object reaches the conveyor path; and a gap-altering device for setting a gap between said two conveyor elements to a value depending on a measured thickness before the flat object reaches the conveyor path, said gap-altering device setting the gap between said two conveyor elements such that, after a setting the gap is smaller than the measured thickness and a difference between the measured thickness and the gap is smaller than a predetermined limit;

the transport device transporting the flat object standing in an upright position over the conveyor path defining an upright object, with said two conveyor elements being embodied to grip the upright object and at times to clamp the upright between said two conveyor elements, to move the flat object at a same speed as said two conveyor elements and to transport the upright object over the conveyor path.

15. The transport device according to claim 14, wherein:

said gap-altering device has a gap data memory with read and write access, said gap data memory storing a value for the gap between said two conveyor elements; and said gap-altering device embodied for setting the gap, to read a previous value of the gap from said gap data memory and to store a set value for the gap in said gap data memory.

16. A transport device for transporting a flat object over a conveyor path, the transport device comprising:

two conveyor elements;

a thickness sensor for measuring a thickness of the flat object before the flat object reaches the conveyor path; and a gap-altering device for setting a gap between said two conveyor elements to a computed value depending on a measured thickness before the flat object reaches the conveyor path, said gap-altering device setting the gap between said two conveyor elements such that, after a setting the gap is smaller than the measured thickness and a difference between the measured thickness and the gap is smaller than a predetermined limit;

the transport device transporting the flat object standing in an upright position over the conveyor path defining an upright object, with said two conveyor elements being embodied to grip the upright object and at times to clamp the upright between said two conveyor elements, to move the flat object at a same speed as said two conveyor elements and to transport the upright object over the conveyor path.

* * * * *